United States Patent [19]

Crowley

[11] 4,271,966

[45] Jun. 9, 1981

[54] SORTING MACHINE

[75] Inventor: Kenneth H. Crowley, Northfleet, England

[73] Assignee: Gunson's Sortex Limited, London, England

[21] Appl. No.: 2,864

[22] Filed: Jan. 11, 1979

[30] Foreign Application Priority Data

Jan. 11, 1978 [GB] United Kingdom ..... 1069/78

[51] Int. Cl.[3] ..... B07C 5/00

[52] U.S. Cl. ..... 209/576; 250/431; 350/63

[58] Field of Search ..... 209/576–588; 250/431, 226, 227; 350/63

[56] References Cited

U.S. PATENT DOCUMENTS

| | | | |
|---|---|---|---|
| 3,236,376 | 2/1966 | Boyce | 209/580 |
| 3,389,792 | 6/1968 | Anderson | 209/577 |
| 3,861,198 | 1/1975 | Shea | 350/63 X |
| 4,057,146 | 11/1977 | Castaneda | 209/581 |
| 4,076,374 | 2/1968 | Schwab | 350/63 |

*Primary Examiner*—Allen N. Knowles

*Attorney, Agent, or Firm*—Cushman, Darby & Cushman

[57] ABSTRACT

A sorting machine has a member a part of which has a translucent viewing area. Material to be sorted is passed adjacent to but spaced from a surface on the translucent viewing area. Light passing through the translucent viewing area is viewed and, in dependence on such viewing, an ejector separates desired and undesired material. A film of washing liquid is directed over the surface of the translucent viewing area, the film then passing to a liquid removal zone which is located on another surface of the member. The liquid removal zone is disposed in a position in which the ejector does not cause the material to be wetted by the liquid.

13 Claims, 4 Drawing Figures

SORTING MACHINE

FIELD OF THE INVENTION

This invention concerns a sorting machine.

DESCRIPTION OF THE PRIOR ART

In our British patent specification No. 1,136,424 there is disclosed a sorting machine having a transparent glass tube through the interior of which a stream of material to be sorted falls freely under gravity. The internal surface of the glass tube is washed by a film of washing liquid, and the said stream of material is viewed through this film. Immediately below the glass tube is a pneumatic ejector which directs a jet of air towards the stream of material so as to remove undesired material therefrom.

In such a sorting machine, however, the jet from the pneumatic ejector impinges on the liquid which drains from the bottom end of the tube and tends to cause the latter to wet the material. Such wetting, however, is highly undesirable. For example, if the material which is being sorted is constituted by pieces of glass cullet, the object being to recover glass of a predetermined colour and supply the latter as raw material to a glass-making furnace, then, if the sorting involves wetting the pieces of glass cullet, considerable extra power will need to be supplied to the furnace so as to evaporate the said liquid.

Again, if the material to be sorted is an agricultural product such as peas, beans, coffee, or rice, any wetting of the product is liable to promote deterioration thereof.

Moreover, the air disturbance caused by the jet from the pneumatic ejector tends to produce ripples and distortion in the film of liquid passing over the internal surface of the glass tube, and such ripples and distortion adversely affect the viewing through the film and therefore adversely affect the standard of sorting.

SUMMARY OF THE INVENTION

According to the present invention, there is provided a sorting machine having a member of a part of which has a translucent viewing area, means for passing material to be sorted adjacent to but spaced from a surface of said translucent viewing area; viewing means for viewing light passing through the translucent viewing area; ejector means controlled by said viewing means, for separating desired and undesired material; and means for directing over said surface a film of washing liquid which thereafter passes to a liquid removal zone which is located on another surface of said member, the liquid removal zone being disposed in a position in which the ejector means does not cause the material to be wetted by the liquid.

The term "material" is used in this specification in a broad sense as including objects such, for example, as peas, beans, coffee, rice, lumps of ore and pieces of glass cullet.

Preferably, the first-mentioned surface is inclined to the horizontal so that the material may pass thereover under gravity, the said other surface being a downwardly facing surface onto which the said film passes by surface tension. Thus the first-mentioned surface may be disposed at an angle of at least 60° to the horizontal, and may if desired be vertical. The said other surface is preferably at right angles to the first-mentioned surface.

The ejector means is preferably a pneumatic ejector arranged to direct a jet of air onto the material without removing liquid from said film.

The said member may comprise a housing within which the said viewing means is disposed, the said material being passed externally of said housing.

The housing may have a window which provides the said translucent viewing area, there being means disposed externally of said housing for directing a beam of light or other electromagnetic radiation through said window and onto the said viewing means so that said material passes through said beam.

The housing may be provided with a plate which is disposed parallel to and spaced from said window and which does not occlude the said translucent viewing area, the plate having a surface remote from the window over which the material may slide prior to passing through said beam, and the film of washing liquid passing through the space between the plate and the window. Means may be provided for altering the size of said space.

The said other surface is preferably provided on a lowermost surface of the housing, the said lowermost surface having a projection which causes the film of washing liquid to be detached from the lowermost surface.

Means may if desired be provided for heating the washing liquid prior to the latter passing over the translucent viewing area.

The invention is illustrated, merely by way of example, in the accompanying drawings.

DESCRIPTION OF THE PREFERRED EMBODIMENT

Figure 1:
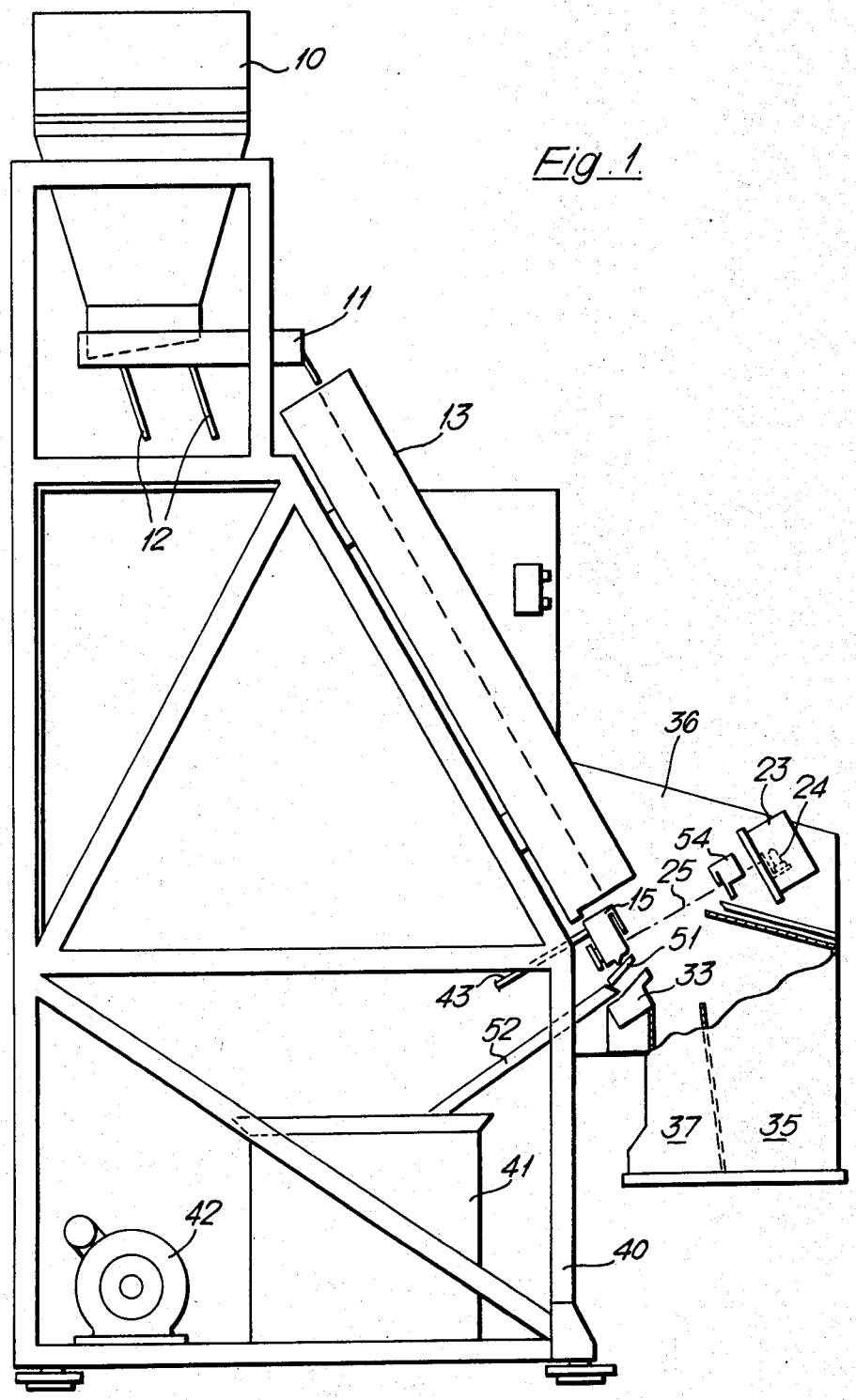
FIG. 1 is a side view of a sorting machine according to the present invention.

Referring to the drawings, a sorting machine according to the present invention is provided with a hopper 10 which is adapted to receive material to be sorted, e.g. municipal solid waste comprising a mixture of pieces of glass, ceramics, bottle tops and other materials, from which it is desired to recover the glass. The material is fed from the bottom of the hopper 10 to a tray 11 which is mounted on springs 12, the tray 11 being vibrated (by means not shown) so as to feed the material to the upper end of an inclined chute 13 which is substantially U-shaped in cross-section. The material leaving the lower end of the chute 13 slides under gravity over or passes under gravity on front of a plate 14 (FIGS. 2 and 3) which is secured to a sealed detector housing 15.

The detector housing 15 is made generally of metal but is provided with a window 16, e.g. of glass or sapphire. The window 16 has an external surface 17 which is disposed parallel to the plate 14 and is spaced from the latter by a gap 20 the size of which may be adjusted, e.g. by means of screws or cams as schematically shown in FIG. 3 at 30*a*.

Within the detector housing 15 there is a cavity 21 within which there is mounted a light-sensitive viewing member 22.

A lamp housing 23 is mounted externally of the detector housing 15, a lamp 24 being mounted in the lamp housing 23. The lamp 24 is arranged to direct a beam 25 of monochromatic light (or other electromagnetic radiation) which passes through a window 26 in a plate member 27. The beam 25 which has passed through the window 26 is directed through the window 16 and onto the light-sensitive viewing member 22. Thus the material which has slid over or passed in front of an outer surface 30 of the plate 14, i.e. a surface remote from the window 16, and which has thus passed externally of the detector housing 15, passes through the beam 25.

Figure 3:
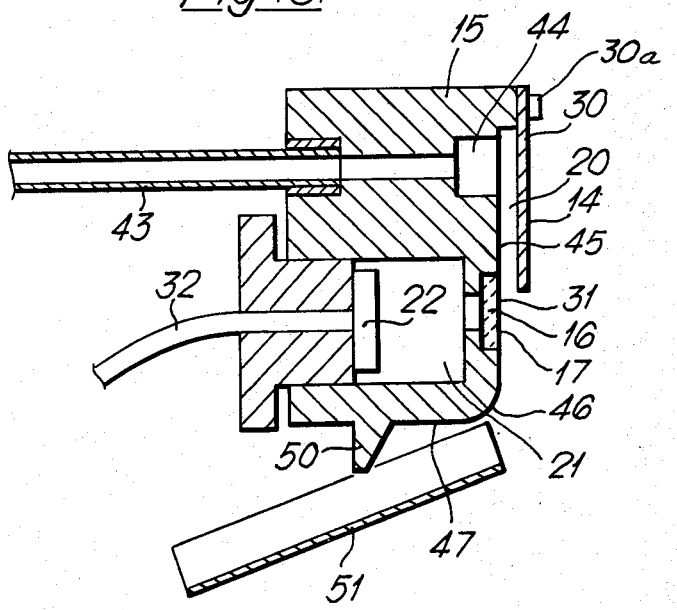
FIG. 3 is a cross-sectional view of a detector housing forming part of the structure shown in FIGS. 1 and 2.

It will be noted from FIG. 3 that the plate 14 somewhat overlaps the window 16 but nevertheless does not occlude a translucent viewing area 31 thereof through which the beam 25 passes.

The light-sensitive viewing member 22 is connected by a lead 32 to an electronic comparator (not shown) which compares signals from the light-sensitive viewing member 22 with a datum. When the said signals are such as are derived from undesired material, e.g. non-transparent material in the case of the municipal solid waste mentioned above, a pneumatic ejector 33 is actuated which directs a jet 34 of air onto the undesired material. As a result, the undesired material is deflected into a "reject" compartment 35 of a bin 36, while the remaining material which has travelled past the detector housing 15 and pneumatic ejector 33 falls into an "accept" compartment 37 of the bin 36.

The chute 13, detector housing 15 and pneumatic ejector 33 are carried by a frame 40 at the bottom of which there is mounted a tank 41. The tank 41 is adapted to contain an aqueous liquid suitable to effect washing of the surface 17 of the window 16 so as to wash away any dust or foreign matter deposited thereon. Thus the washing liquid, which may if desired be heated, may be water which has been treated with a wetting agent. A pump 42 pumps the washing liquid (by means not shown) at a predetermined pressure to a pipe 43 which communicates with a plenum chamber 44 within the detector housing 15. The washing liquid supplied to the plenum chamber 44 passes as a film over an external surface 45 of the detector housing 15 and thus passes through the gap 20 and over the translucent viewing area 31 whose surface 17 is co-planar with the surface 45. In passing over the surface 17, the film of washing liquid will remove any dust or foreign matter but will not adversely affect the quality of the sorting effected by the beam 25 which passes therethrough.

Figure 2:
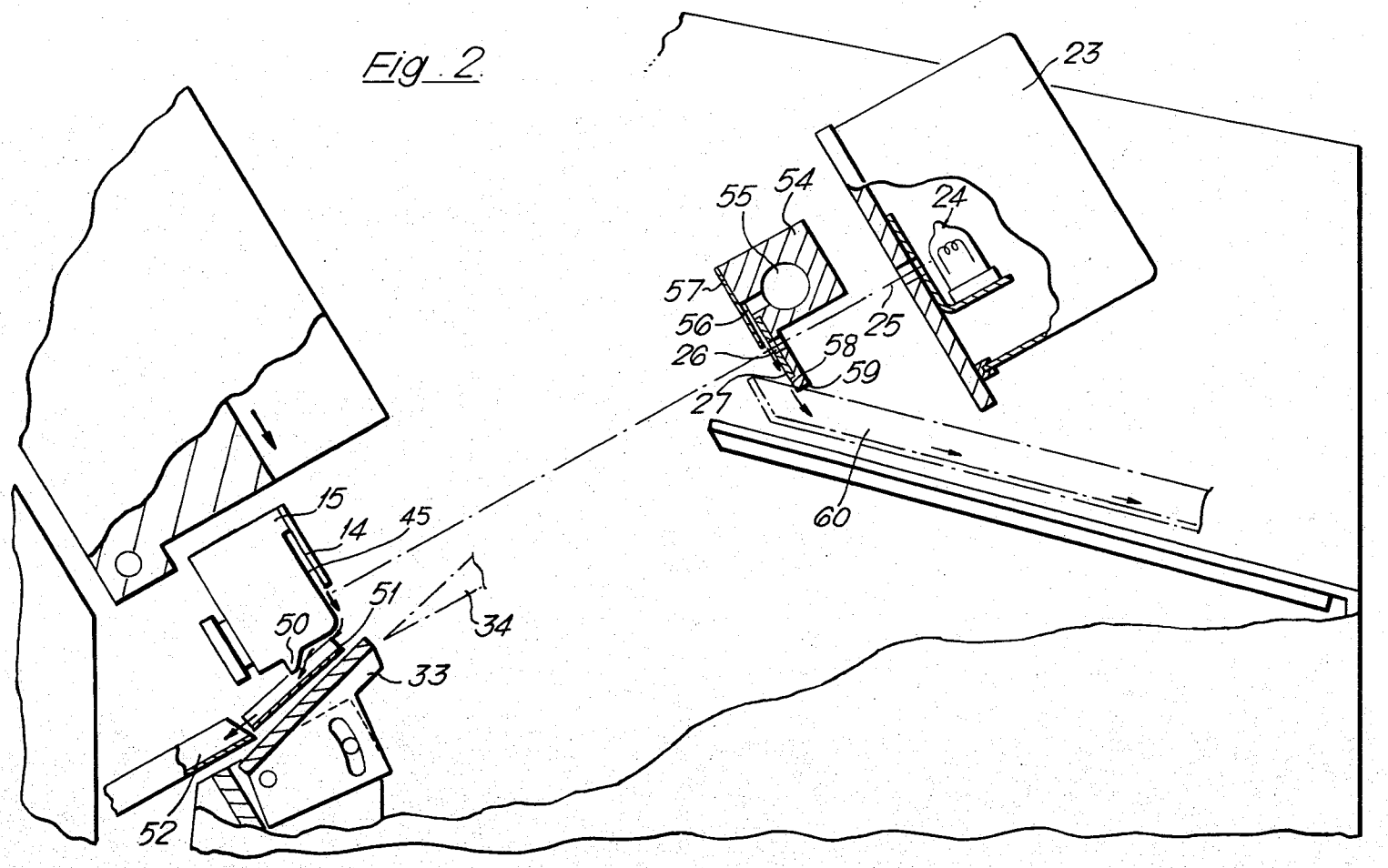
FIG. 2 shows a part of the structure of FIG. 1 on a larger scale.

After passing over the surface 17, the film of washing liquid passes over the lower part of the surface 45 and thence over a radiused surface 46 to a downwardly facing surface 47. The surface 45, and the surface 17 co-planar therewith, may be vertical or, as best shown in FIG. 2 , inclined to the horizontal at an angle other than 90° so that the material may pass thereover under gravity. Thus the said angle is preferably at least 60°. The surface 47, which is the lowermost surface of the detector housing 15, is substantially at right angles to the surface 45 and is thus downwardly inclined from the radiused surface 46. The film of washing liquid, however, adheres to the surfaces 45, 46 and to the portion of the surface 47 adjacent the surface 46, by surface tension, the film of washing liquid being able to travel from the surface 45 to the surface 47 without being detached therefrom by reason of the provision of the radiused surface 46.

The surface 47 has a projection 50 which causes the film of washing liquid to be detached from the surface 47 at a liquid removal zone. The liquid removed at the liquid removal zone passes to a chute 51 from which it is returned to the tank 41 by way of a conduit 52.

As best shown in FIG. 2, the said liquid removal zone at the projection 50 is disposed in a position in which the pneumatic ejector 33, which is disposed below the surface 45, does not cause the material to be wetted by the washing liquid. Thus the jet of air 34 is directed away from the surface 45 as shown in FIG. 2 and onto the material without removing liquid therewith and without causing ripples in, or distortion of, the film of washing liquid passing over the surface 17. Such ripples would in any case be unlikely to develop in the said film by reason of the fact that the latter can be made very thin.

Figure 4:
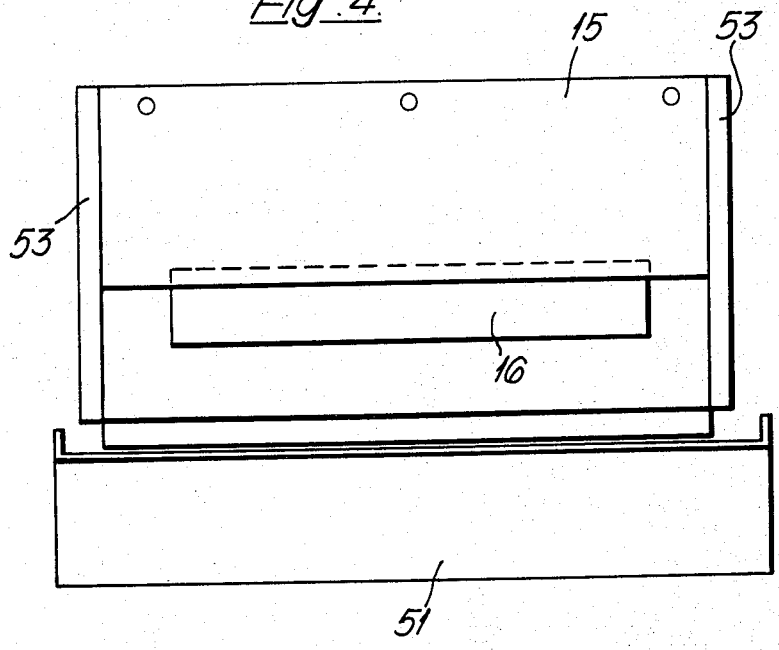
FIG. 4 is a front view of the said detector housing.

Plates 53 (FIG. 4) are provided at opposite ends of the detector housing 15 to assist in obtaining adequate distribution of the washing liquid over the whole of the window 16 and surface 45.

The plate member 27 is secured to a housing 54 within which there is a chamber 55. The chamber 55 is arranged to receive (by means not shown) a pressurised supply of washing liquid from the tank 41. Washing liquid from the chamber 55 passes to a space 56 between the housing 54 and a plate 57 which is secured to the housing 54, the washing liquid passing from the space 56 to flow downwardly as a film over the plate member 27 and thence to a drain chute 60 from which it is returned (by means not shown) to the tank 41. Thus the last-mentioned film of washing liquid flows downwardly over a surface 58 of the plate member 27 which is inclined to the horizontal and which faces the material being sorted and serves to remove dust and foreign matter deposited on the window 26. This film of washing liquid, however, does not travel by surface tension over a donwardly facing surface 59 of the housing 54 since the latter is not connected to the surface 58 by a radiused surface.

The beam 25, instead of being a beam of visible light, could be an X-ray beam, or a beam of ultra-violet light for use in fluoresence sorting.

Moreover a plurality of beams 25 could be used to illuminate the material from different directions, while a plurality of light-sensitive viewing members 22 could be employed which were sensitive to light of different colours.

A guard (not shown) may be disposed in front of the windows 16 to protect the latter from spray.

As will be appreciated, the washing of the windows 16, 26 requires only small quantities of washing liquid since washing is effected by the use of films of liquid, and the areas which are to be washed are quite small. Moreover, as clearly shown in FIG. 2, it is not necessary for the windows 16, 26 to be disposed vertically since it is sufficient for the windows 16, 26 to be downwardly inclined and for the washing liquid to be supplied to their upper ends.

I claim:

1. A sorting machine having a member a part of which has a translucent viewing area; means for passing material to be sorted adjacent to but spaced from a surface of said translucent viewing area, said surface being inclined to the horizontal so that the material may pass thereover under gravity; viewing means for viewing light or other electromagnetic radiation passing through the translucent viewing area; ejector means, controlled by said viewing means, for separating desired and undesired material; and means for directing over said surface a film of washing liquid which thereafter passes by surface tension to a liquid removal zone which is located on a downwardly facing surface of said member, the liquid removal zone being disposed in a position in which the ejector means does not cause the material to be wetted by the liquid.

2. A sorting machine as claimed in claim 1 in which the first-mentioned surface is disposed at an angle of at least 60° to the horizontal.

3. A sorting machine as claimed in claim 1 in which the said other surface is at right angles to the first-mentioned surface.

4. A sorting machine as claimed in claim 1 in which means are provided for heating the washing liquid prior to the latter passing over the translucent viewing area.

5. A sorting machine having a housing provided with a window having a translucent viewing area; viewing means, disposed within the housing, for viewing light or other electromagnetic radiation passing through the window; a plate which is disposed parallel to and spaced from said window and which does not occlude the said translucent viewing area; means for passing material to be sorted over a surface of said plate remote from the window; means disposed externally of said housing for directing a beam of light through said window and onto the said viewing means, the material sliding over the said surface of the plate prior to passing through said beam; ejector means, controlled by said viewing means, for separating desired and undesired material; and means for directing through the space between the plate and the window a film of washing liquid which is directed over the surface of the window and which thereafter passes to a liquid removal zone which is located on a surface of said housing remote from said window, the liquid removal zone being disposed in a position in which the ejector means does not cause the material to be wetted by the liquid.

6. A sorting machine as claimed in claim 5 in which means are provided for altering the size of said space.

7. A sorting machine as claimed in claim 5 in which the said surface remote from said window is provided on a lowermost surface of the housing, the said lowermost surface having a projection which causes the film of washing liquid to be detached from the lowermost surface.

8. A sorting machine as claimed in claim 5 in which the surface of the plate is inclined to the horizontal so that the material may pass thereover under gravity, the said surface remote from the window being a downwardly facing surface onto which the said film passes by surface tension.

9. A sorting machine having a member a part of which has a translucent viewing area; means for passing material to be sorted adjacent to and spaced from an external surface of said translucent viewing area; viewing means for viewing light or other electromagnetic radiation passing through said translucent viewing area; pneumatic ejector means disposed below said external surface and controlled by said viewing means to produce a jet directed away from said external surface for separating desired and undesired material, and means for directing a film of washing liquid over said external surface, said film of washing liquid thereafter passing to a liquid removal zone, said external surface and said liquid removal zone being disposed in positions in which said ejector means does not cause the material being separated to be wetted by the liquid and cause ripples or distortions in the film of washing liquid passing over said external surface.

10. A sorting machine as claimed in claim 9 in which the said member comprises a housing within which the said viewing means is disposed, the said material being passed externally of said housing.

11. A sorting machine as claimed in claim 10 in which the housing has a window which provides the said translucent viewing area, there being means disposed externally of said housing for directing a beam of light or other electromagnetic radiation through said window and onto the said viewing means so that said material passes through said beam.

12. A sorting machine as claimed in claim 9 in which the film passes from said external surface to the liquid removal zone by surface tension.

13. A sorting machine as claimed in claim 9 in which said liquid removal zone is located on another external surface of said member.

* * * * *